United States Patent [19]

Leachman, Jr.

[11] Patent Number: 4,643,635

[45] Date of Patent: Feb. 17, 1987

[54] VAPOR CORE CENTRIFUGAL PUMP HAVING MAIN AND LOW FLOW IMPELLERS

[75] Inventor: Frank A. Leachman, Jr., Bristol, Conn.

[73] Assignee: Chandler Evans Inc., West Hartfort, Conn.

[21] Appl. No.: 626,934

[22] Filed: Jul. 2, 1984

[51] Int. Cl.[4] ..... F04D 15/00

[52] U.S. Cl. ..... 415/1; 415/62; 415/143; 415/157

[58] Field of Search ..... 415/157, 1, 143, 145, 415/158, 62, 69, 39, 40, 78, 13, 14, 150, 86, 87, 88, 28, 49, 50

[56] References Cited

U.S. PATENT DOCUMENTS

| | | | |
|---|---|---|---|
| 2,210,155 | 8/1940 | Szydlowski et al. | 415/157 X |
| 2,342,219 | 2/1944 | Price | 415/150 |
| 3,005,311 | 10/1961 | Ross | 415/157 X |
| 3,106,165 | 10/1963 | Tyler | 415/150 |
| 3,142,259 | 7/1964 | Tyler | 415/157 X |
| 3,204,863 | 9/1965 | Hausammann | 415/158 X |
| 3,408,943 | 11/1968 | Rimmer | 415/49 X |
| 3,426,964 | 2/1969 | Silvern | 415/49 |
| 3,482,523 | 12/1969 | Morando | 415/49 X |
| 3,504,986 | 4/1970 | Jackson | 415/28 X |
| 3,576,375 | 4/1971 | Jackson | 415/143 X |
| 3,624,704 | 11/1971 | Leonard | 415/88 X |
| 3,658,440 | 4/1972 | Jackson | 415/143 X |
| 3,671,136 | 6/1972 | O'Mara et al. | 415/88 X |
| 4,408,953 | 10/1983 | Nasvytis et al. | 415/62 |
| 4,487,548 | 12/1984 | Leachman et al. | 415/28 |

FOREIGN PATENT DOCUMENTS

| | | | |
|---|---|---|---|
| 661672 | 6/1938 | Fed. Rep. of Germany | 415/78 |
| 1079954 | 4/1960 | Fed. Rep. of Germany | 415/158 |
| 1311898 | 11/1962 | France | 415/39 |
| 144384 | 3/1931 | Switzerland | 415/157 |
| 1194041 | 6/1970 | United Kingdom | 415/157 |
| 1388562 | 3/1975 | United Kingdom | 415/88 |
| 1423365 | 2/1976 | United Kingdom | 415/157 |

*Primary Examiner*—Everette A. Powell, Jr.
*Attorney, Agent, or Firm*—Richard A. Dornon

[57] ABSTRACT

A vapor core centrifugal fuel pumping system (10') has a main flow impeller (72) and a low flow impeller (81) mounted upon the front plate (74) of the main flow impeller. Both of the impellers receive flow from an inlet passage (26') which proceeds past an inlet throttling valve (114). During pumping operation of the low flow impeller, a surface (122) on the inlet throttling valve forms a labyrinth seal with the radially inner lip (120) of the front plate to reduce inlet fuel flow entering the main impeller. A first check valve (124) and a second check valve (126) respectively prevent flow from the low flow impeller from entering the main flow impeller and flow from the main impeller from entering the low flow impeller. The second check valve is associated with conduits (140, 142) to evaculate liquid adjacent the main impeller during operation of the low flow impeller to reduce windage losses. The pumping system does not engender excessive pressure or flow transients during changeover between low flow operation and normal flow operation. Also, the pumping system imparts minimal temperature rise to the fuel being pumped and is not susceptible to significant cavitation erosion.

21 Claims, 8 Drawing Figures

VAPOR CORE CENTRIFUGAL PUMP HAVING MAIN AND LOW FLOW IMPELLERS

TECHNICAL FIELD

This invention relates to vapor core centrifugal pumping systems and more particularly to those pumping systems employed to provide fuel to gas turbine engines.

BACKGROUND ART

A conventional fuel control system for a gas turbine engine comprises an engine driven main fuel pump and a metering control adapted to sense various engine parameters for controlling the rate of fuel flow to the engine's combustion chambers in accordance therewith. Main fuel pumps and existing fuel control systems are generally fixed displacement gear pumps or vane pumps which provide output flows which exceed engine fuel requirements under certain conditions (e.g., high altitude operations). Such main fuel pumps, therefore, necessitate the bypassing of fuel which engenders fuel heating, impairs pumping efficiency and creates other problems such as detracting from the ability of the fuel to cool engine accessories and oil and hydraulic systems without exceeding a maximum safe engine temperature at the burner nozzles. Moreover, positive displacement pumps require close operating clearances and contain parts with highly stressed metal-to-metal contacts which wear rapidly in low lubricity fuel. In addition, the performance of positive displacement pumps may be adversely affected by the presence of contaminants.

While high speed centrifugal pumps are relatively insensitive to contaminants and are capable of generating the fuel pressure required for engine operation in their normal speed range, under high turndown conditions (low flows at high pump speeds), the fuel in a centrifugal pump becomes unduly heated owing to the dissipation of mechanical energy.

A centrifugal pump arranged to operate with a central hollow core of fuel vapor and a liquid annulus or ring around the pump rotor (such as shown in U.S. Pat. Nos. 3,128,822 and 4,247,263) offers greater efficiency than a conventional centrifugal pump and a consequential reduction in temperature rise in the fluid being pumped. The reason for such reduced temperature rise is that windage losses beget by the impeller become smaller when the radial depth of the liquid annulus is reduced.

Experience with vapor core pumps has shown, however, that for the most critical high turndown ratios (lowest engine flow, which may be only 1% of maximum design flow, at close to maximum speed), a vapor core impeller designed to produce adequate pressure for engine operation at maximum fuel flow, typically imparts more energy to the fuel than is required. The excess energy imparted to the fuel by the impeller is then wasted by inefficiency in the collector and diffuser, which recover static head (pressure) from the fluid dynamic head possessed by the fluid at the point where it leaves the impeller, thereby occasioning temperature rise in the fuel. Also, when vapor core pumps are operated at high speed, low headrise conditions, the outer edges of the impeller blades typically produce cavitation in the fluid ring adjacent the collector. Cavitation bubbles produced in this way often destructively collapse on the collector and diffuser surfaces. The resulting cavitation erosion may cause a significant reduction in pump life.

DISCLOSURE OF INVENTION

In accordance with the invention, there is provided a vapor core centrifugal pump having a main impeller element and at least one additional impeller element adapted to generate a pressure rise lower than that of the main impeller element and to operate over a limited range of flow. The impeller elements may be arranged in such a manner that modulation of the flow between main and additional impeller elements is continuous whereby the occurrence of discharge pressure transients or discharge flow transients during transitions between low flow operation and high flow operation may be eliminated.

In gas turbine engine applications, utilization of a pump of the invention can result in significant reductions in fuel temperature rise due to the reduced energy input to the pumped fuel by the additional impeller element during high turndown operation. Moreover, a pump of the invention is less susceptible to incurring cavitation damage since the main impeller may be operated only in a range where tip static pressures exceed the fuel vapor pressure whereby cavitation can be eliminated at the outer tips of the main impeller. Because cavitation in a pump of the invention can be substantially eliminated or at least ameliorated, an increased pump operating life is possible.

Accordingly, it is a primary object of the invention to provide a vapor core centrifugal pump having a main impeller element and an additional impeller element adapted to generate a pressure rise lower than that of the main impeller element.

This and other objects and advantages of the invention will become more readily apparent from the following detailed description when taken in conjunction with the accompanying drawings, in which:

BEST MODE OF CARRYING OUT THE INVENTION

Figure 1:
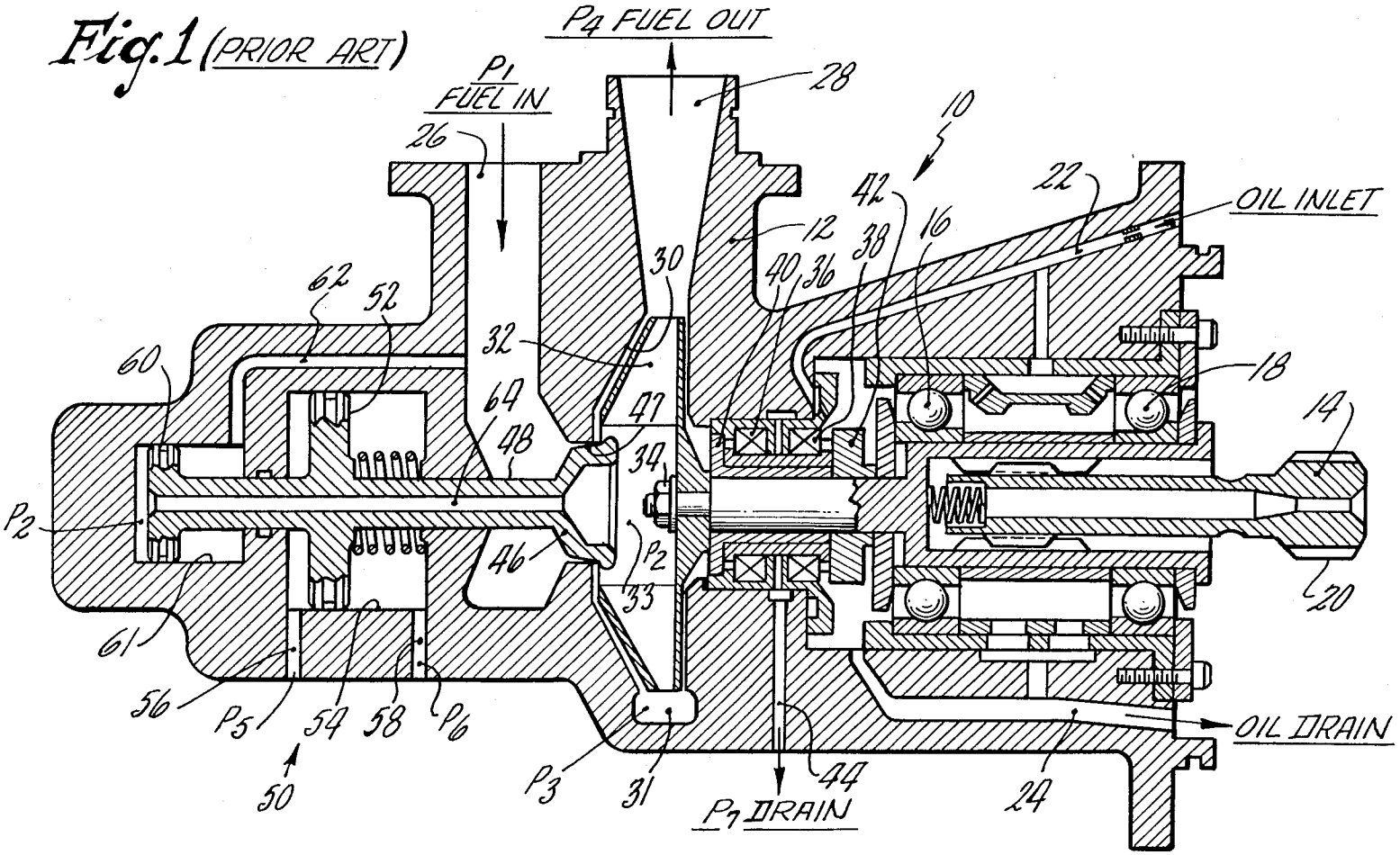
Fig. 1 (PRIOR ART)
FIG. 1 is a schematic view of a typical prior art vapor core centrifugal pump.

Referring now to the drawings, wherein like primed numerals are used to designate like elements throughout the several figures, there is shown in FIG. 1, a typical prior art vapor core centrifugal pump generally indicated at 10. The pump 10 may be employed in a fuel control system for a gas turbine engine to vary output pressure so as to hold a constant pressure differential across a metering valve by inlet throttling.

With reference to FIG. 1, the pump 10 comprises a plural cavity housing 12 having a drive shaft 14 mounted for rotation therein upon bearings 16 and 18. The drive shaft 14 may be driven at high speed by a gas turbine engine by connecting the splined right end 20 thereof to the engine gearbox. The bearings 16 and 18 are supplied with lubricating oil through a supply passage 22. A drain passage 24 conducts lubricating oil to the outside of the housing 12. The housing 12 is provided with an inlet passage 26 and a diffuser outlet passage 28 which communicate with a pumping cavity 30 which includes a collector 31 formed within the housing 12. Mounted within the pumping cavity 30, upon the left end of the drive shaft 14 is an impeller 32. A nut 34 functions to secure the impeller 32 to the drive shaft 14. A pair of carbon face seals 36 and 38 are disposed in a seal retainer mounted in the housing 12 just to the rear of the pumping cavity 30. The seals 36 and 38 respectively engage the seal faces of sealing flanges 40 and 42 which are carried by the shaft 14 for rotation therewith. Any leakage of either fuel past seal 36 or oil past seal 38 is adapted to be conducted to the exterior of the housing 12 by a drain passage 44.

Flow from the inlet passage 26 proceeds past a bell-shaped inlet throttling valve 46 into the eye of the impeller 32. The inlet valve 46 is carried upon the end of a control shaft 48 which is mounted in the housing 12 for axial sliding movement therein for controlling the valve opening with respect to a metering edge 47. An actuator, generally shown at 50, functions to control the position of the inlet valve 46 such that a constant differential pressure or head is maintained across the metering valve of the fuel control. The actuator comprises a spring loaded piston 52 mounted upon the control shaft mounted for axial sliding movement within a cavity 54 in the housing 12 and having its sides referenced to signal pressures via control ports 56 and 58. A balance piston 60 mounted in a cavity 61 upon the left end of the control shaft 48 has its right face referenced to inlet pressure via conduit 62 and its left face referenced to the pressure in the eye of the impeller by a passage 64 extending through the control shaft. Hence, the pressure forces acting on the inlet valve 46 are always counterbalanced by the forces acting on the piston 60.

Figure 2:
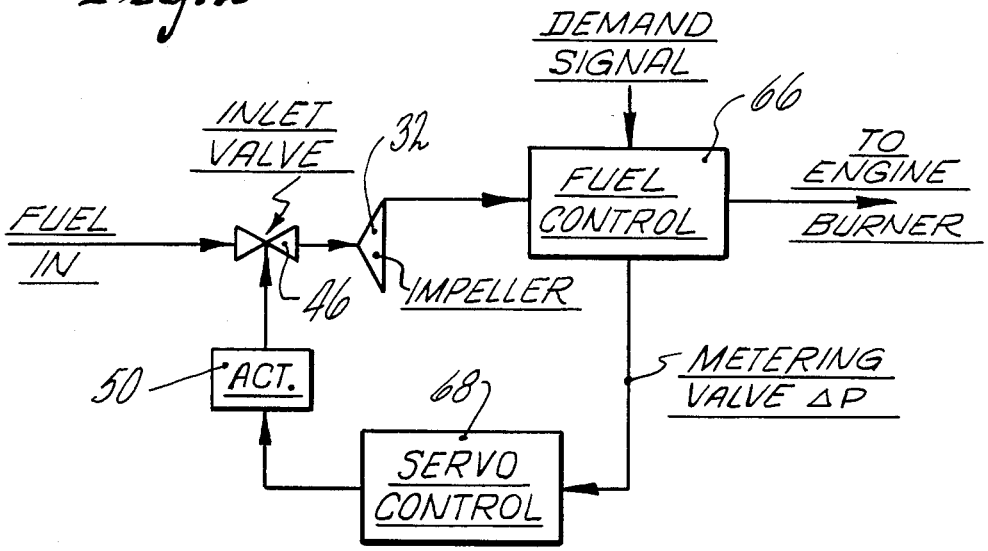
FIG. 2 is a schematic diagram of a prior art fuel control system for a gas turbine engine incorporating a vapor core centrifugal pump, such as shown in FIG. 1.
Figure 3:
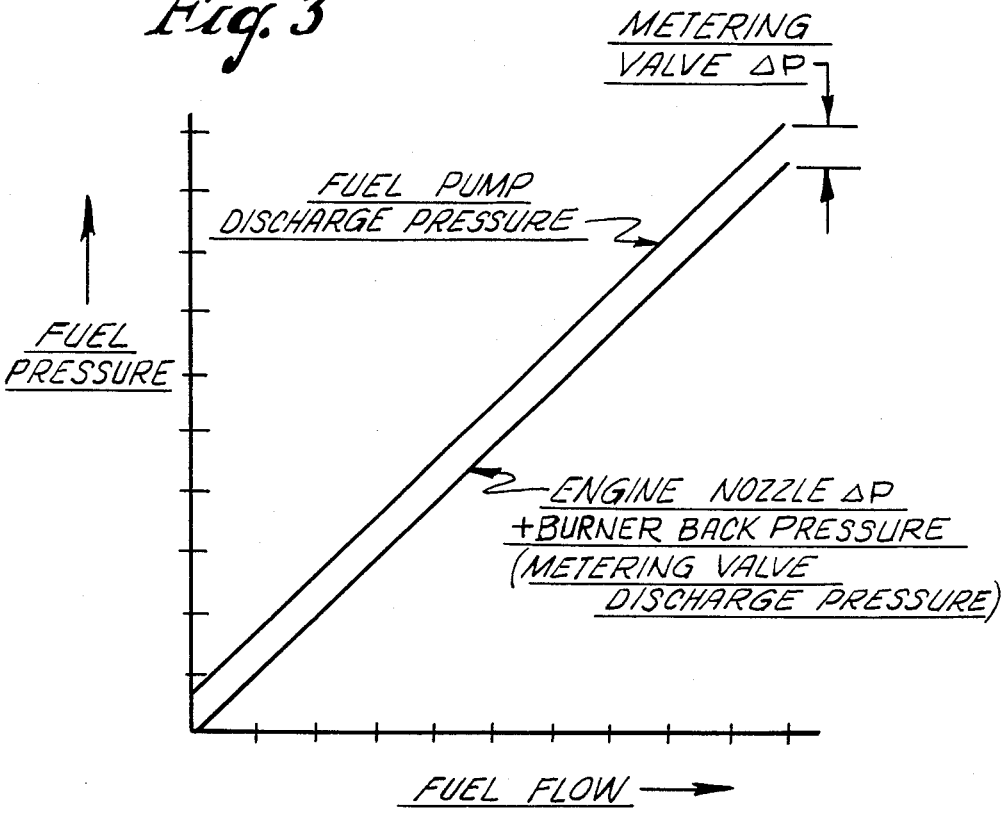
FIG. 3 is a graph showing the relationship between fuel pump discharge pressure, metering valve discharge pressure and fuel flow in a system as depicted in FIG. 3.

As shown in FIG. 2, the differential pressure or head across the metering valve (not shown) of fuel control 66 is sensed by a servo control 68 which generates the signal pressures to the actuator 50 for controlling the position of the inlet valve. With reference to FIG. 3, it may be seen that the pump discharge pressure is approximately proportional to metered flow and to the metering valve discharge pressure which is equal to the sum of the pressure drop across the engine burner nozzles and the burner back pressure. It should be noted that vapor core centrifugal pumps are best suited to those aircraft fuel system applications in which there is a generally linear relationship between fuel control metering valve discharge pressure and fuel flow. In addition, vapor core pumps are particularly useful for supplying fuel to gas turbine engine afterburners where pressure falls substantially with reduced fuel flow.

Succinctly stated, the actuator 50 controls the position of the inlet valve 46 of the pump 10 to hold the same constant head across the metering valve. The throttling of the impeller pump inlet causes a core of vapor to form in the eye 33 of the impeller. The diameter of the core is determined by the downstream restriction and the position of the inlet valve 46. Impeller friction is moderated by operating the impeller partially in vapor, thereby conserving power and reducing fuel temperatures.

During normal operation, fuel at inlet pressure $P_1$ enters the pump 10 through inlet passage 26. Inlet valve 46 is displaced to a position to the right of that shown, which is the closed position. Fuel from inlet passage 26 passes through open valve 46 and thence into impeller eye 33. Because impeller 32 rotates at high speed, fluid entering the eye 33 acquires rotodynamic energy as it progresses radially through the impeller 32 and exits the impeller 32 at high velocity into collector 31. The purpose of the collector 31 is to act as a conduit for the high velocity fluid leaving the impeller 32 and to guide this fluid to the entrance of the diffuser 28, which converts most of the fluid velocity head into fluid static head (pressure) at a level sufficient to overcome the various pressure losses in the fuel control and engine burner nozzles (FIGS. 2 and 3).

A principal advantage of the vapor core centrifugal fuel pump over a conventional centrifugal fuel pump is the ability to control the vapor core pump pressure rise to only the level required by adjusting the radial depth of the ring of fluid inside the impeller 32 and collector 31. When low fuel pressure rise is required, the depth of the fluid ring (measured radially inward from the inner wall of the collector 31) is reduced. Typically, this fluid ring resides entirely outside of the impeller 31 at the lowest pressure rises required.

The vapor core in impeller 31 is developed by regulating the opening between inlet valve 46 and metering edge 47 such that the pressure drop across it ($P_1-P_2$) is sufficient to reduce the fuel pressure to either the vapor pressure of the fuel (which allows some fuel to vaporize at impeller eye pressure $P_2$, thereby creating a core of fuel vapor) or to a slightly higher pressure which liberates air dissolved in the fuel (thereby creating a core of mostly air inside the impeller, instead of only fuel vapor).

It will be understood that as the depth of the fluid ring is reduced, with the region radially inward from its surface being filled with vapor (vapor core), the windage power expended in overcoming the viscous shear and turbulence losses in the fluid existing between the rotating impeller shrouds and the adjacent stationary housing walls, will also be reduced. This reduction in impeller windage power arises from the fact that the viscous shear and turbulence losses incurred by an impeller spinning in a gas (fuel vapor or air liberated from the fuel) are much less than those incurred by an impeller rotating at equivalent speed in liquid fuel.

To assure a proportional relationship between the fuel control metering opening and the magnitude of the flow passing through it, a constant pressure differential is desired across this metering orifice. Accordingly, the control servo system senses this metering valve pressure differential and adjusts inlet valve 46 by controlling pressures $P_5$ and $P_6$ such that inlet valve 46 is displaced to the degree of opening which causes the development of the impeller fluid ring depth and corresponding pump discharge pressure P4 required The energy of the fluid as it exits the outer periphery of the impeller is the sum of its staic and dynamic heads. The static head corresponds to the pressure developed in a forced vortex. The dynamic head, or kinetic energy of the fluid, is proportional to is velocity squared. For a vapor core centrifugal impeller operating at zero flow:

Total Head = Static Head + Dynamic Head $$H = C_1\left(\frac{U_2^2 - U_1^2}{2g}\right) + C_2\left(\frac{U_2^2}{2g}\right) \quad (1)$$

Where:

H = total fluid headrise, ft.

$U_2$ = tangential velocity at impeller outer periphery, ft/sec $U_1$ = tangential velocity at radially inner surface of impeller fluid ring, ft/sec $C_1, C_2$ = constants accounting for losses g = gravitational constant, 32.174 ft/sec.

When a vapor core is introduced at the eye of the impeller, the gas core produces a negligible contribution to the static headrise, whereby static head developed in the impeller decreases as the radius of the vapor core increases (velocity $U_1$ increases, in equation (1)).

Figure 4:
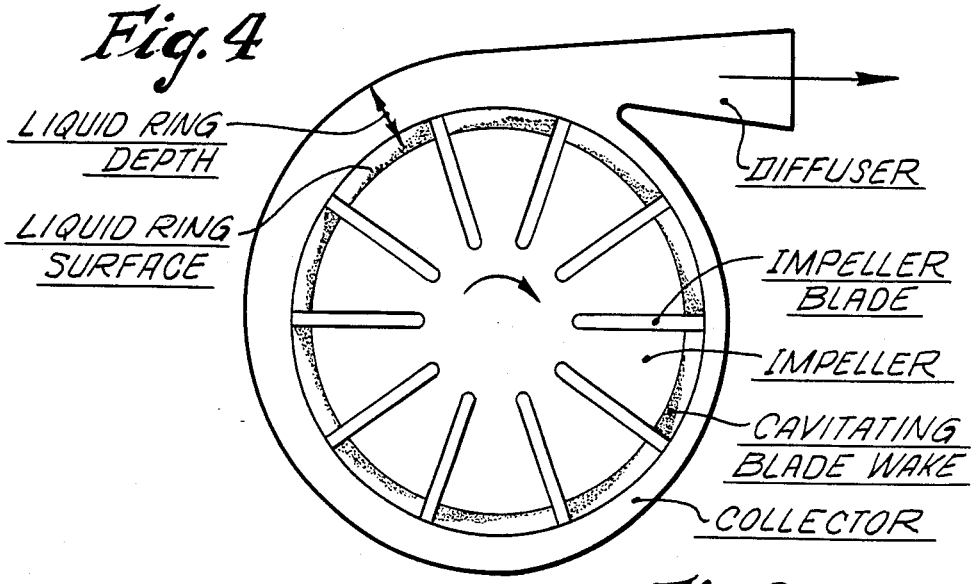
FIG. 4 is an illustration of a vapor core centrifugal pump experiencing cavitation adjacent the impeller blade tips.

The origin of the cavitation problem experienced by vapor core pumps can now be explained. During operation at low impeller headrise; i.e., small fluid ring depth, as shown in FIG. 4, the velocity of the fluid in the ring is reduced to a value less than the impeller outer tangential velocity, by mixing energy loss to the fluid in the collector, which has velocity about one-half impeller tip velocity. This means the impeller blade tip moves through the shallow surface of the fluid ring much like a paddle wheel, creating a low pressure wake behind each blade.

The static head reduction in the blade tip wake is approximately:

$$H_w \cong H_{s2} - \frac{(U_2 - C_{u2})^2}{2g} \quad (2)$$

Where:

$H_w$ = fluid head in wake region downstream of blade tip, ft $H_{s2}$ = static head at pressure side of blade tip, ft $C_{u2}$ = local fluid tangential velocity, ft/sec.

If the static pressure in the wake falls below the fluid vapor pressure, cavitation bubbles can form in the wake:

$$P_v \geqq \rho g\left[H_{s2} - \frac{(U_2 - C_{u2})^2}{2g}\right] \leqq \text{CAVITATION} \quad (3)$$

Where:

$P_v$ = fluid vapor pressure, lb/ft$^2$ $\rho$ = fluid mass density, slugs/ft$^3$.

When the fluid ring depth becomes very shallow (as a result of pump operation at low headrise) the static head Hs developed in the fluid ring is often inadequate to maintain the blade wake pressure above fluid vapor pressure, and cavitation results. This characteristic is common to all conventional vapor core centrifugal pumps and can significantly reduce the life of the pump, in comparison to conventional centrifugal pumps. Another shortcoming common to known vapor core pumps is the excessive energy imparted to the fluid at high turndown conditions and the resultant fuel temperature rise.

Although the fuel temperature rise of a vapor core pump is typically lower than that of a conventional centrifugal pump, opportunities for further temperature rise reduction exist. Equation (1) shows that the static and dynamic components of pump headrise are approximately equal for an ideal pump ($C_1 = C_2 = 1$) operating with no vapor core ($U_1 = 0$). If the pump is operated with full vapor core (i.e., the vapor core fills the entire impeller, and the fluid ring resides in the collector only), the impeller still imparts enough dynamic head to the fluid to generate one-half of the maximum pump pressure rise, if this velocity head is efficiently recovered. At the highest turndown ratios, however, the required pump pressure rise may be only 15% of the maximum pump pressure rise. In vapor core pumps of the previous art, this 15% headrise would be obtained by inefficiently diffusing the fluid having dynamic head equivalent to 50% of maximum pump headrise. The remaining energy, equivalent to 35% of maximum pump headrise, would be lost in fuel heating.

Figure 5:
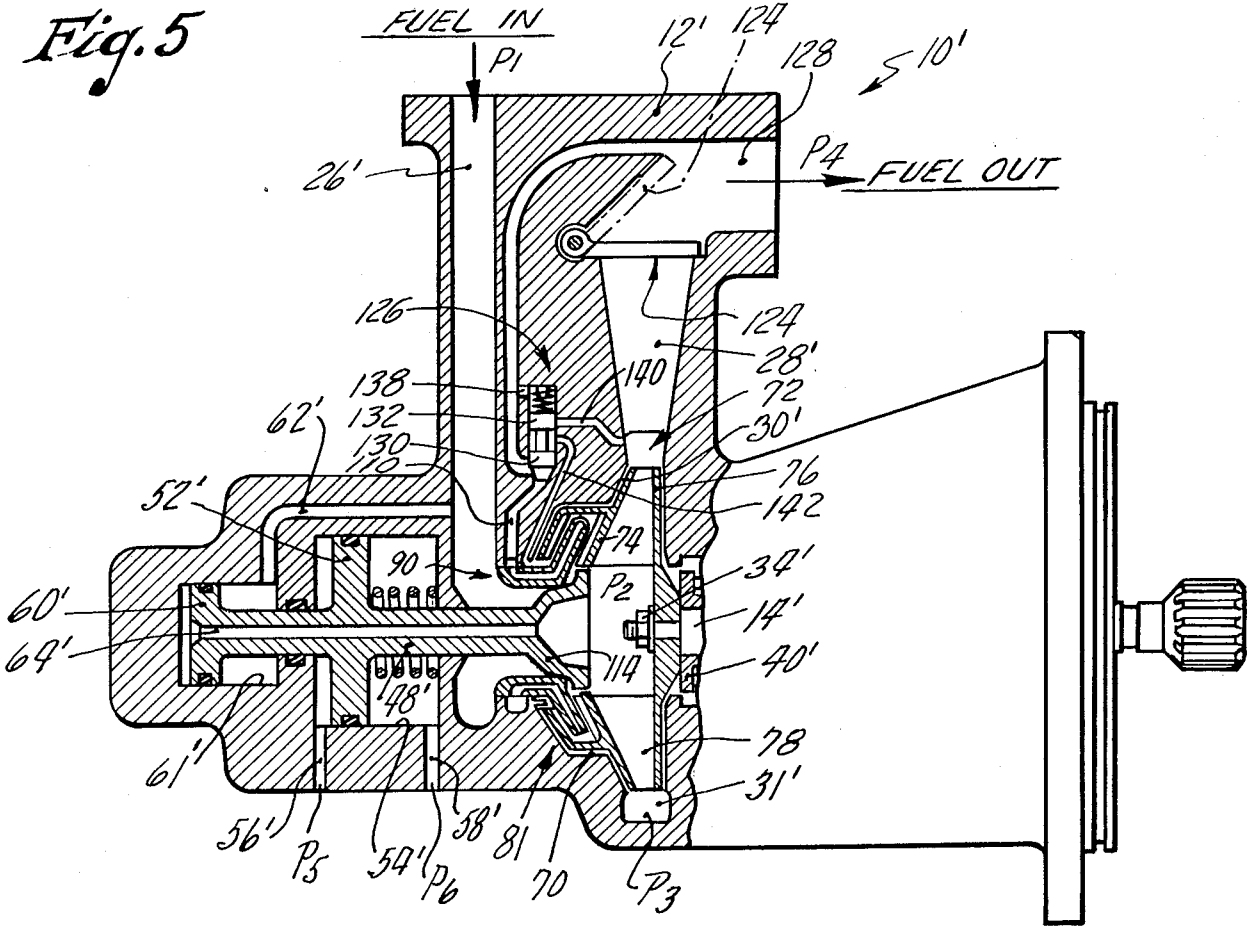
FIG. 5 is a schematic view of a vapor core centrifugal pump of the invention.

Referring to FIG. 5, a preferred embodiment of the invention is schematically depicted. It will be appreciated that the pump 10' of FIG. 5 is substantially identical to that of FIG. 1 with respect to the housing, drive assembly, and inlet valve actuation mechanism, and hence, like elements are designated by like primed numerals.

Figure 6:
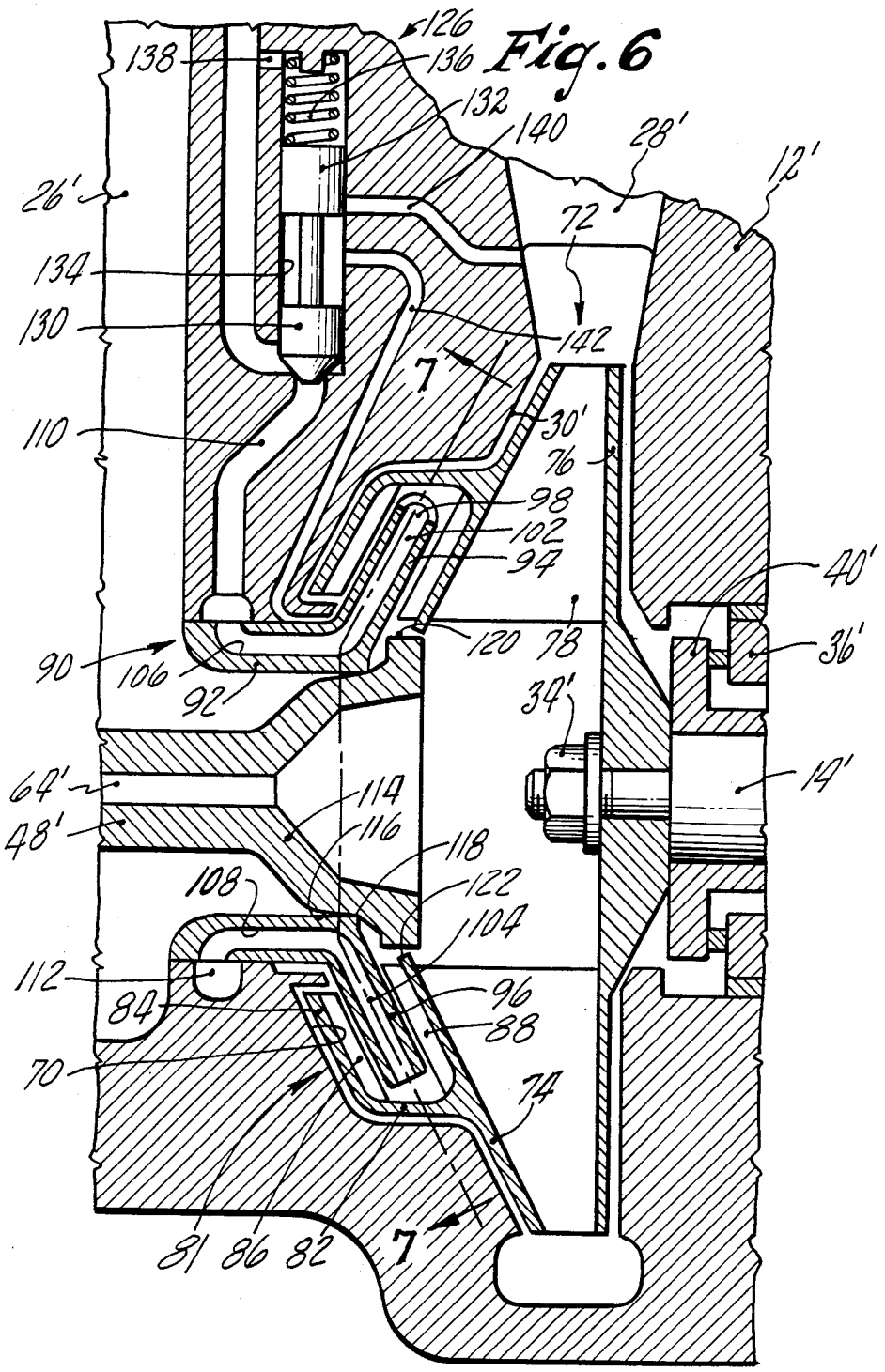
FIG. 6 is an enlarged view of the impeller shown in FIG. 5.

With continued reference to FIG. 5, and reference to FIG. 6, it will be seen that a pumping cavity is formed within the housing 12'. The pumping cavity is defined by a main pumping cavity 30' which includes a collector 31' and an additional or low flow pumping cavity 70 which opens into and communicates with the main pumping cavity. Inlet passage 26' communicates directly with the low flow pumping cavity 70 and with the main pumping cavity 30' through the low flow pumping cavity 70. Flow from the collector 31' is discharged to a diffuser outlet passage 28'.

Mounted for rotation within the pumping cavity 30' is a main impeller 72 which comprises a shroud constituted by a front plate 74 and a back plate 76 and a plurality of circumferentially spaced, radially extending blades 78 extending therebetween and attached to the inboard surfaces of both plates 74 and 76 in the usual manner. The front surface of the plate 74 defines the usual frustroconical surface; and the plate 74 has an interior circular lip 122 which extends radially inwardly beyond the blades and functions as a sealing surface.

Attached to the front surface of the front plate 74 is a low flow impeller, generally shown at 81, and partially defined by a cylindrical flange 82 which extends parallel to the pump axis into the low flow pumping cavity 70 in closely spaced relationship to its interior peripheral wall. A plate 84, having a front frustroconical surface extends radially inward and is integral with the front edge of the flange 82. It will be noted that the plate 84 is in generally parallel relationship to the plate 74 and, together with the flange 82 and the radially inner front surface portion of the plate 74, defines the shroud of the low flow impeller 81. A first array of circumferentially spaced, radially extending blades 86 is attached to the rear surface of the plate 84 and a second array of circumferentially spaced, radially extending blades 88 is attached to the front surface of the plate 74. The low flow impeller 81 is thus formed by a shroud and the small impeller blades 86 and 88.

Figure 8:
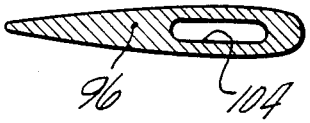
FIG. 8 is a sectional view of the pitot tube taken substantially along the line 8—8 of FIG. 7.
Figure 7:
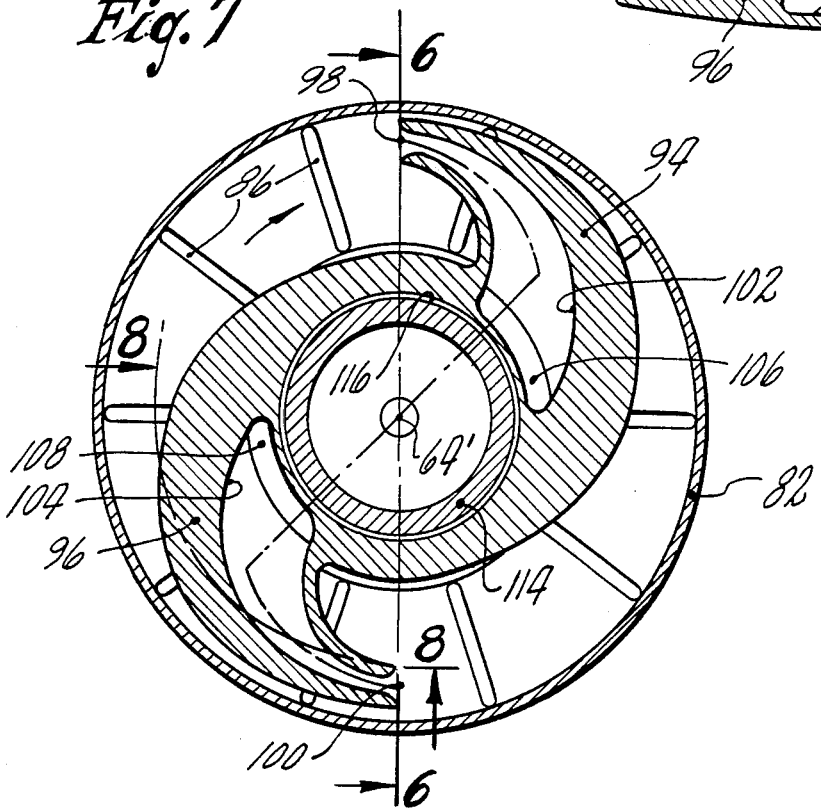
FIG. 7 is a sectional view of the pitot tube, taken substantially along the line 7—7 of FIG. 6.

In order to collect the pumped fluid from the outer periphery of the fluid vortex within the low flow impeller 81, there is furnished a collection member, generally designated, 90, which is integral with or fixedly attached to the housing 12'. The construction and arrangement of the fixedly positioned collection member 90 may be best understood and appreciated by reference to FIGS. 6–8. It should, however, be noted that the sectional view of the collection member 90 of FIGS. 5 and 6 is taken along the line 6—6 of FIG. 7. The collection member 90 includes a hub 92 having an inner peripheral surface, which defines a portion of the inlet passage 26', and a pair of identical spiral arms 94 and 96 which extend radially and rearwardly from the rear end of the hub 92 into the channel formed between blades 86 and 88. The tips of the arms (which are akin to pitot tubes) extend closely adjacent the inner surface of the flange 82 and have circular inlets 98 and 100 with axes extending in the circumferential direction for efficient flow recovery. The circular inlets 98 and 100 at the tips of arms 94 and 96 communicate with spiral passages 102 and 104 in the arms 94 and 96, respectively, which progressively increase in width in the radially inward direction. The passages 102 and 104, in turn, respectively communicate with axially extending passages 106 and 108 in the hub 92. Flow from the passages 106 and 108 is directed to a low flow discharge passage 110 via an annulus 112 formed in the housing 12'. As shown in FIG. 8, the arms have an air foil shaped cross-section to provide for greater efficiency.

An inlet valve 114, attached to a control shaft 48', throttles inlet flow to both the small low flow impeller 81 and the larger main impeller 72. Although the inlet valve 114 is similar in shape to the inlet valve 46, it is of a slightly different outer contour for directing flow into the eye of the low flow impeller 81 and for sealing off flow from the eye of the impeller 72, as will more readily apparent. Inlet valve 114 has a conical surface 116 which forms an annular metering opening with a circular metering edge 118. In FIG. 6, the conical surface is depicted in abutting relationship with the metering edge which is the closed inlet valve position in which flow enters neither of the impellers 72 and 81. The right end of the valve 114 has an enlarged diameter portion with a cylindrical surface 120 which, when in juxtaposed relationship to the inner peripheral edge 122 of the plate 74 of the main impeller 72, forms a close-clearance fluid labyrinth seal to reduce flow entering the eye of the main impeller 72 during operation of the low flow impeller. It will be appreciated that the slope of the conical surface 116 and the rear wall of the enlarged diameter portion function to guide the incoming flow in a radially outward direction into the eye of the low flow impeller 81. In addition, it should be noted that the metering opening formed between the metering edge 118 and the conical surface 116 is of a size sufficient to form a vapor core in the inlet region of the low flow impeller 81.

Spring loaded check valves, generally shown at 124 and 126, are respectively provided in the diffuser outlet passage 28' and the low flow discharge passage 110 for preventing flow from either impeller from reaching the other. In FIGS. 5 and 6, the check valves are illustrated in the closed positions. From FIG. 5 it will be observed that flow from both passages 28' and 110 enters a main discharge conduit 128 and may proceed thence to the fuel control 66 of FIG. 2.

The valve 126 is a spool valve having two lands 130 and 132 which is mounted in the housing 12' for axial sliding movement within a close fitted cavity or sleeve 134. A spring 136 urges the valve spool downwardly such that the conical end of the land 130 is seated in the low flow discharge passage 110 so as to block off flow therein. A duct 138 is incorporated in the housing 12' to fluidly interconnect the upper part of the cavity 134 with the low flow discharge passage 110, thereby referencing the outboard surface of the land 132 to the pressure therein. Hence, during operation of the main impeller 72, the outward surface of the land 132 is referenced to pressure from the main discharge conduit 28' whereby flow therefrom is prevented from entering the low flow impeller 81.

During operation of the low flow impeller 81, the valve 126 functions to perform a purging operation with respect to any residual fuel which may have leaked into the main impeller 72, past the labyrinth seal defined between the lip 122 of the plate 74 and the cylindrical surface 120 of the inlet valve 114. Purging of the main impeller 72 of liquid fuel during low flow operation is beneficial since it reduces windage power losses therein by permitting the main impeller 72 to operate in a purely air or vapor environment. To carry out the purging operation, the housing 12' has a conduit 140 which fluidly interconnects the cavity 134 adjacent land 132 and the outer surface of the collector 31'. Another conduit 142 in housing 12' fluidly interconnects the annular volume between the lands 130 and 132 to the eye of the low flow impeller 81 which will be at a pressure close to fuel vapor pressure during low flow operation. Hence, during low flow operation, the valve 126 is displaced upwardly, thereby establishing fluid communication between collector 31' and the eye of the low flow impeller 81. Fuel leaking past the labyrinth seal or any residual fuel in the main pumping cavity 30' is thus included in the pumped inlet flow of the low flow impeller 81 whenever valve 126 is in a partial or full open position during low flow operation.

During low flow operation, fuel enters pump inlet passage 26' at pressure $P_1$ and experiences a pressure loss to $P_2$ as it passes the metering edge 118. With the inlet valve 114 opened only slightly, the outer periphery 120 of the inlet valve 114 forms a close-clearance fluid labyrinth seal with the radially inner edge 122 of the impeller front plate 74. Fluid passing metering edge 118 is thereby directed into low flow impeller 81 during low flow (e.g., about 10% of maximum pump flow) operation. During such operation, the metering edge pressure loss is sufficient to form a vapor core in the inlet region of low flow impeller 81. It should be noted that the low flow impeller 81 is sized to produce only 10% to 50% of the maximum pump pressure rise (this being the pressure rise required to generate 10% of maximum pump flow rating of the pump 10'.

Fluid is collected at the open, radially outer ends of the arms 94 and 96 of collection member 90 during low flow operation. This flow is directed through passages 102,104,106,108 and 110 to the lower end of check valve 126. The fluid pressure generated by impeller 81 overcomes the light spring load holding valve 126 against its lower (closed) stop, thereby raising valve 126 upwardly and allowing flow through low flow discharge passage 110 and main discharge conduit 128. During low flow operation, the check valve 124 is held by a spring (not shown) in its closed position. Residual fuel in the main pumping cavity 30' or any fuel leaking past the labyrinth seal therein is evacuated to the inlet of impeller 81 through drain conduit 140 and 142 to lessen power losses.

During a transition from low flow operation (low flow impeller flowing, main impeller operating in vapor) to high flow operation (low flow impeller shutoff, main impeller flowing), the following sequence of events occurs: Increased fuel flow is demanded which results in the fuel control metering valve opening further. This latter action produces a reduction in metering valve pressure differential. The servo control 68 senses this reduced metering valve pressure differential and functions to increase metering valve differential pressure to its normal level by directing appropriate pressures $P_5$ and $P_6$ to actuator 50' whereby shaft 48' and valve 114 are displaced rightwardly, creating a larger inlet valve opening. Then, inlet valve 114 admits more fuel to the impeller 72 which increases the radial depth of the liquid ring and increases the pump 10' pressure rise. If the increase in pump pressure rise demanded cannot be met by the low flow impeller 81, the actuator 50' drives the valve 114 further to the right, thus admitting fuel to the main impeller. The main impeller then fills immediately to a liquid ring depth which produces the same pressure in diffuser 28' that exists in the main discharge conduit 128. The check valve 124 is closed during this transition, whereby any pressure pulsation in diffuser 28 is isolated from the fuel control which is downstream of check valve 124. It is only when the main impeller pressure rise exceeds the low flow impeller pressure rise that check valve 124 opens and engine flow is thereafter supplied by the main impeller. When this occurs, the pump discharge pressure, communicated to the upper end of check valve 126 through duct 138 biases valve 126 to its closed position, preventing flow from the main impeller 72 from entering the collection member 90 of the low flow impeller 81.

The use of a low flow impeller designed for low pressure reduces fuel temperature rise during low flow operation. Although it is possible to devise a pumping system employing two separate, nonvapor-core impellers, the transient pressure pulses that would occur in such a system when switching from one impeller to another could have a deleterious effect on fuel control and engine operation. Hence, the invention offers an advantageous arrangement of two impeller pumps, one a low flow impeller and the other a high flow impeller, in association with a continuously modulating inlet valve in which transitions from one impeller to the other may be smooth and free from pressure pulsations.

It will also be appreciated that, with respect to a pump of the invention, because the main impeller immediately fills during low to high flow transitions to a liquid ring depth corresponding to the maximum pressure of the low flow impeller, the main vapor-core impeller is never operated for extended periods of time with shallow liquid ring depths which cause cavitation damage. By sizing the low flow impeller pressure rise (and therefore the pressure rise at which the flow transition between the low flow and main impellers occurs) in accordance with the constraints of equation (3), the pump can avoid being subjected to the cavitation damage that reduces the life of vapor-core pumps.

Obviously, many modifications and variations are possible in light of the above teachings without departing from the scope or spirit of the invention as defined in the appended claims.

I claim:

1. An improved vapor core centrifugal pumping system of the type comprising: a housing having an inlet passage, an outlet passage and a pumping cavity therein in communication with the inlet and outlet passages; a main impeller mounted for rotation in the pumping cavity; and a positionable inlet throttling valve mounted in the housing for throttling flow from the inlet passage entering the main impeller, and wherein the improvement comprises:

the housing having a low flow pumping cavity, the inlet throttling valve being located to throttle flow from the inlet passage to the low flow pumping cavity;

a low flow impeller mounted for rotation in the low flow pumping cavity; and the housing having a low flow discharge passage in communication with the low flow pumping cavity for receiving flow therefrom.

2. The pumping system of claim 1, wherein the improvement further comprises:

seal means responsive to movements of the inlet throttling valve to seal off flow from the inlet passage to the main impeller during pumping operation of the low flow impeller.

3. The pumping system of claim 1, wherein the main impeller is of the type comprising:

a front plate, a back plate and a plurality of blades extending therebetween and wherein the improvement further comprises:

the low flow impeller being mounted upon the front plate.

4. The pumping system of claim 1, wherein the improvement further comprises:

a collection member fixedly attached to the housing and having at least one arm extending radially into the low flow impeller for collecting flow, the collection member being in fluid communication with the low flow discharge passage for discharging collected flow thereto.

5. The pumping system of claim 1, wherein the improvement further comprises:

a first check valve in the outlet passage for preventing flow in the low flow discharge conduit from entering the main impeller during low flows; and a second check valve in the low flow discharge passage for preventing flow from the outlet passage from entering the low flow impeller during normal flows; and the housing having a main discharge conduit communicating with the low flow discharge passage and the outlet passage for selectively receiving flow from the low flow discharge passage and the outlet passage.

6. The pumping system of claim 5, wherein the improvement further comprises:

means to evacuate liquid from the pumping cavity in which the main impeller is mounted during low flow pumping operation of the low flow impeller for reducing windage losses.

7. The pumping system of claim 6, wherein the evacuating means comprises:

conduit means to fluidly interconnect the pumping cavity in which the main impeller is mounted to the low flow impeller; and valve means to permit flow in the conduit means during low flow pumping operation of the low flow impeller.

8. The pumping system of claim 7, wherein the valve means comprises:

a spool having a land thereupon, the land being adapted to control flow through the conduit means.

9. The pumping system of claim 2, wherein the main impeller is of the type having a front plate and wherein the seal means comprises:

the outer periphery of the inlet throttling valve and a radially inner lip on the front plate.

10. An improved vapor core centrifugal pumping system of the type comprising: a housing having an inlet passage, an outlet passage, a main pumping cavity therein in communication with the inlet and outlet passages; a main impeller mounted for rotation in the main pumping cavity; and a positionable inlet throttling valve mounted in the housing for throttling flow from the inlet passage entering the main impeller, and wherein the improvement comprises:

the housing having a low flow pumping cavity opening into and communicating with the main pumping cavity, the inlet throttling valve being located to throttle flow from the inlet passage to the low flow pumping cavity and the main pumping cavity;

a low flow impeller mounted upon the main impeller for rotation therewith in the low flow pumping cavity;

the housing having a low flow discharge passage in communication with the low flow pumping cavity for receiving flow therefrom.

11. The pumping system of claim 10, wherein the improvement further comprises:

seal means responsive to movements of the inlet throttling valve to seal off flow from the inlet passage to the main impeller during operation of the low flow impeller.

12. The pumping system of claim 10, wherein the improvement further comprises:

first check valve means for preventing flow in the low flow discharge conduit from entering the main impeller during low flows; and second check valve means for preventing flow from the outlet passage from entering the low flow impeller during normal flows.

13. The pumping system of claim 10, wherein the improvement further comprises:

a collection member fixedly attached to the housing and having at least one arm extending radially into the low flow impeller for collecting flow, the collection member being in fluid communication with the low flow discharge passage for discharging collected flow thereto.

14. The pumping system of claim 11, wherein the main impeller is of the type having a front plate and wherein the seal means comprises:

the outer periphery of the inlet throttling valve and a radially inner lip on the front plate.

15. The pumping system of claim 10 wherein the improvement further comprises:

means to evacuate liquid from the main pumping cavity during low flow pumping operation of the low flow impeller for reducing windage losses.

16. The pumping system of claim 15, wherein the evacuating means comprises:

conduit means to fluidly interconnect the main pumping cavity to the low flow impeller; and valve means to permit flow in the conduit means during low flow pumping operation of the low flow impeller.

17. A method of operating a vapor core pumping system comprising the steps of:

throttling flow to a low flow impeller from an inlet passage with an inlet throttling valve; and throttling flow from the inlet passage to a main impeller with the inlet throttling valve during pumping operation of the main flow impeller.

18. The method of claim 17, further comprising:

sealing off the main impeller from the inlet passage during pumping operation of the low flow impeller.

19. The method of claim 18, wherein the sealing off comprises:

placing a surface on the inlet throttling valve adjacent the main impeller.

20. The method of claim 17, further comprising:

preventing flow from the low flow impeller from reaching the main impeller during pumping operation of the low flow impeller; and preventing flow from the main impeller from reaching the low flow impeller during pumping operation of the main impeller.

21. The method of claim 17, further comprising:

removing liquid from adjacent the main impeller to the low flow impeller during pumping operation of the low flow impeller to reduce windage losses.

* * * * *